US006494781B2

(12) United States Patent
Fujita et al.

(10) Patent No.: US 6,494,781 B2
(45) Date of Patent: Dec. 17, 2002

(54) CARD EDGE CONNECTOR

(75) Inventors: Shinya Fujita, Yokkaichi (JP); Kiyofumi Ichida, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/995,157

(22) Filed: Nov. 27, 2001

(65) Prior Publication Data

US 2002/0064988 A1 May 30, 2002

(30) Foreign Application Priority Data

Nov. 30, 2000 (JP) ..... 2000-365176

(51) Int. Cl.[7] ..... H01R 24/00
(52) U.S. Cl. ..... 459/635; 459/260; 459/595
(58) Field of Search ..... 439/260, 630, 439/635, 637, 595, 259, 636

(56) References Cited

U.S. PATENT DOCUMENTS 4,266,839 A * 5/1981 Aikens ..... 339/75
4,392,700 A * 7/1983 Showman et al. ..... 339/17
5,370,552 A * 12/1994 Chishima et al. ..... 439/495
6,132,224 A * 10/2000 Murakami et al. ..... 439/77
6,238,226 B1 * 5/2001 Schempp et al. ..... 439/260

* cited by examiner

*Primary Examiner*—P. Austin Bradley
*Assistant Examiner*—Truc Nguyen
(74) *Attorney, Agent, or Firm*—Anthony J. Casella; Gerald E. Hespos

(57) ABSTRACT

A first connector housing (1) accommodates substrates (3), and pressing portions (7) extend on opposite sides of the substrates (3). Terminal fittings (5) are accommodated in the second housing (2) and are provided with contact pieces (9) for contacting foil-shaped terminals (4) on outer surfaces of the substrates (3). A contact portion (21) of each elastic contact piece (9) normally is retracted and not in contact with the corresponding terminal (4). When the housings (1, 2) are fitted to each other, the pressing portions (7) press the contact pieces (9) toward the substrates (3), thereby elastically deforming them toward the substrates (3), whereby the contact portions (21) are brought into contact with the terminals (4).

3 Claims, 14 Drawing Sheets

CARD EDGE CONNECTOR

BACKGROUND OF THE INVENTION

1. Field of the Invention

The invention relates to a connector and to a method for mounting such a connector.

2. Detailed Description of the Related Art

A card edge connector is disclosed in Japanese Unexamined Patent Publication No. 56(SHO)-136480 and also is identified by the numeral 100 in FIGS. 22 and 23 herein. The card edge connector 100 is constructed to receive an end of a substrate 101. Terminals 102 in the form of a thin film are provided at the end of the substrate 101. The card edge connector 100 has upper and lower terminal fittings 104 for holding the terminals 102 from opposite sides along the thickness direction of the substrate 101. The terminal fittings 104 are formed with elastic contact pieces 103 that can elastically contact the terminals 102. A spacing L between the contact pieces 103 is less than thickness M of the substrate 101. Thus, the elastic contact pieces 103 hold the substrate 101 at a suitable contact pressure when the substrate 101 is mounted into the card edge connector 100.

The card edge connector 100 has several drawbacks. For example, corners 105 at the end of the substrate 101 may damage the contact pieces 103 while the substrate 101 is being mounted into the connector 100.

Further, the contact pressure between the elastic contact pieces 103 and the terminals 102 needs to be sufficiently high to stabilize contact resistance between the terminal fittings 104 and the terminals 102. This requires a large elastic deformation of the contact pieces 103 and a corresponding short spacing L. Circuits (not shown) in the card edge connector 100 may be shorted by the contact of the upper and lower elastic contact pieces 103 before the substrate 101 is mounted. Additionally, the elastic contact pieces 103 may be deformed.

In view of the above, an object of the invention is to provide a connector and a mounting method to hold a substrate and elastic contact pieces stably in contact with each other while avoiding a short circuit and a deformation of the contact pieces.

SUMMARY OF THE INVENTION

The invention is directed to a connector with a first housing surrounding one or more terminals on an outer end surface of a substrate, and a second housing connectable with the first housing. The second housing has one or more terminal fittings that can be brought into contact with the terminals on the substrate. Each terminal fitting comprises a contact piece that is elastically or resiliently deformable along a thickness direction of the substrate. Thus, the contact piece can be brought elastically or resiliently into contact with a corresponding terminal on the substrate. The first housing comprises at least one pressing portion for pressing the corresponding contact pieces toward the terminals on the substrate when the first and second housings are mated.

The terminals may be provided on only one of the opposite surfaces of the substrate. However, it is preferable to provide the terminals on both opposite surfaces of the substrate to follow the conventional construction of substrates and terminals and to shorten the width of the substrate.

The contact pieces preferably are provided to conform to the location of the terminals of the substrate. Thus, the contact pieces preferably elastically or resiliently contact and hold the substrate from its opposite sides, and contact pressure can be stabilized.

The pressing portions preferably contact the contact pieces directly and are inserted into pressing portion insertion spaces provided in the second housing at a side of the contact pieces opposite from the substrate. The contact pieces can deform elastically or resiliently in the pressing portion insertion spaces and in a direction away from the substrate. Thus, even if the substrate contacts the elastic contact pieces during connection of the two housings, the contact pieces can be deformed elastically or resiliently into the pressing portion insertion spaces. Therefore, the substrate is not likely to damage the contact pieces. Alternatively, second pressing portions may be provided in the second housing for pressing the contact pieces, and the first pressing portions may press the second pressing portions to press the contact pieces indirectly.

The contact pieces preferably are at retracted positions away from the outer surface of the substrate along the thickness direction before the two housings are connected with each other. The pressing portions move the contact pieces into the contact with the terminals after contact portions of the contact pieces pass the corner of the substrate during a connecting operation of the two housings. Thus, the contact pieces are not likely to be deformed by contact with a corner of the substrate when the two housings are being connected.

The contact portion of each contact piece preferably is closer to the front end of the second housing than the distal end of the contact piece is. Additionally, a base portion of the contact piece is more backward than the contact portion. Accordingly, the contact piece has a turned construction and the position where the corresponding pressing portion acts and the position of the contact portion can be proximate to each other along forward and backward direction. Thus, pressing forces from the pressing portions act substantially along the thickness direction of the substrate, and contact pressures acting between the substrate and the contact pieces can be stabilized more easily. Additionally, the distal ends of the contact pieces are not caught by the substrate even if the contact portions are pulled backward by the contact with the substrate during the connecting operation of the two housings.

The second housing preferably comprises one or more cavities for accommodating the respective terminal fittings. Engaging pieces extend into the respective cavities and elastically engage the terminal fittings when the terminal fittings are mounted in proper positions in the cavities. The contact portions preferably are spaced sufficiently from the engaging pieces to avoid contact with the engaging pieces while the terminal fittings are being mounted into the cavities.

The pressing portions preferably contact corresponding press receiving portions of the terminal fittings. The press receiving portions are arranged at an angle different from 0° or 180° with respect to a mating direction of the connector housings.

The second housing preferably is provided with one or more pressing portion insertion openings for inserting corresponding pressing portions into pressing portions insertion spaces in the second housing near the resilient contact pieces. The resilient contact pieces preferably can be deflected into the corresponding pressing portions insertion space in case of an interaction with the substrate.

The invention also is directed to a method of connecting a connector. The connector has a first housing surrounding one or more terminals on outer end surfaces of a substrate, and a second housing connectable with the first housing and provided with one or more terminal fittings that can be brought into contact with the terminals of the substrate. The method comprises providing a contact piece on each terminal fitting which is resiliently deformable towards or away from the substrate. The method also comprises providing one or more pressing portions on the first housing and pressing by means of the pressing portions the corresponding resilient contact pieces substantially toward the terminal portions when the first and second housings are fitted to each other. Thus, the resilient contact pieces of the terminal fittings are brought resiliently into contact with the corresponding terminal portions of the substrate.

The pressing portions preferably press the resilient contact pieces substantially toward the substrate after contact portions of the resilient contact pieces pass a corner of the substrate during a connecting operation of the two housings.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
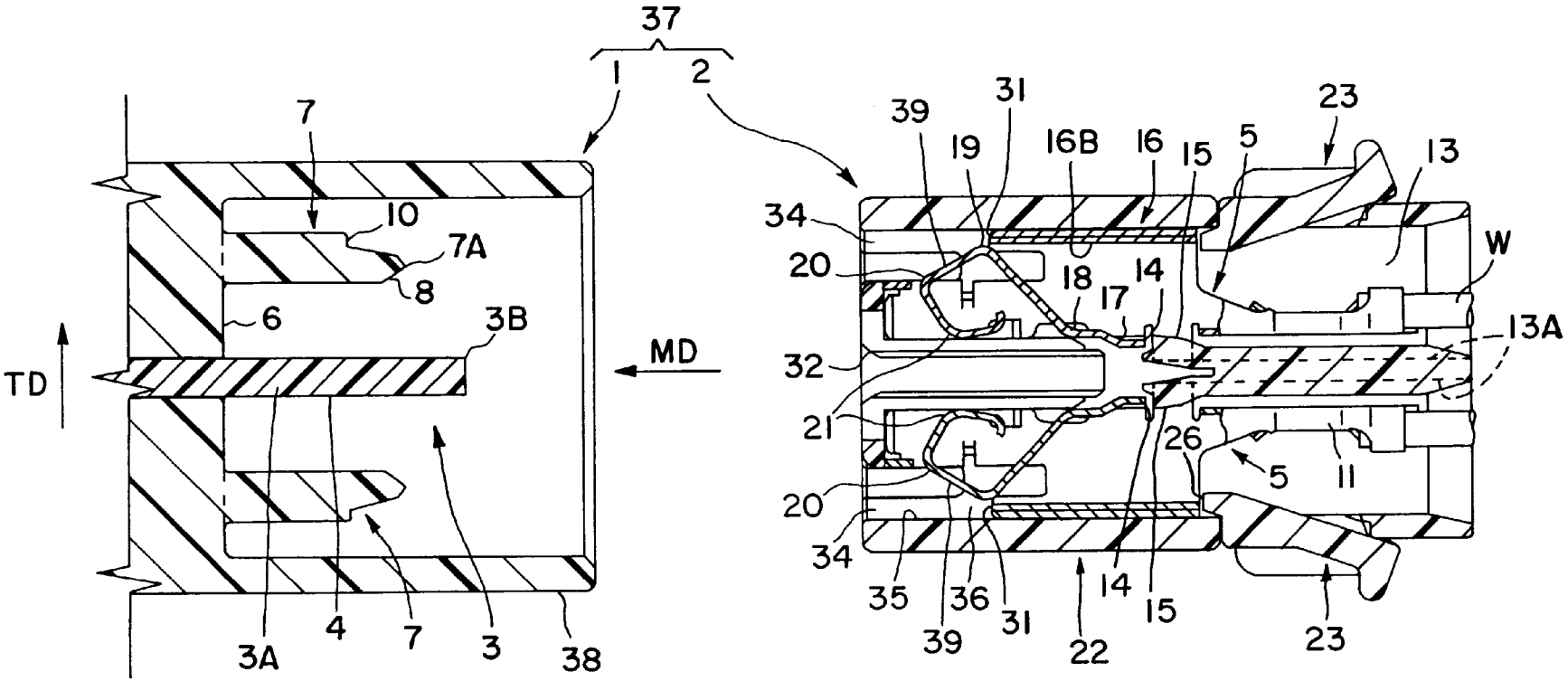
FIG. 1 is a side view in section of a first embodiment before two housings are connected.
Figure 2:
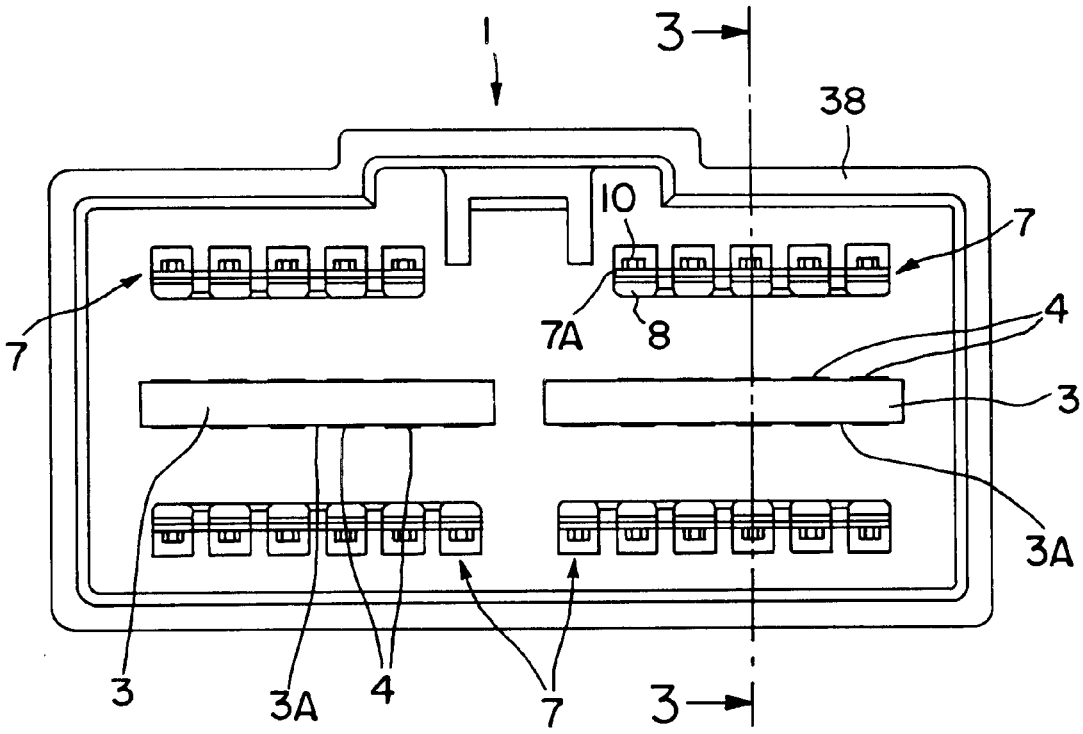
FIG. 2 is a front view of a substrate-side housing.
Figure 3:
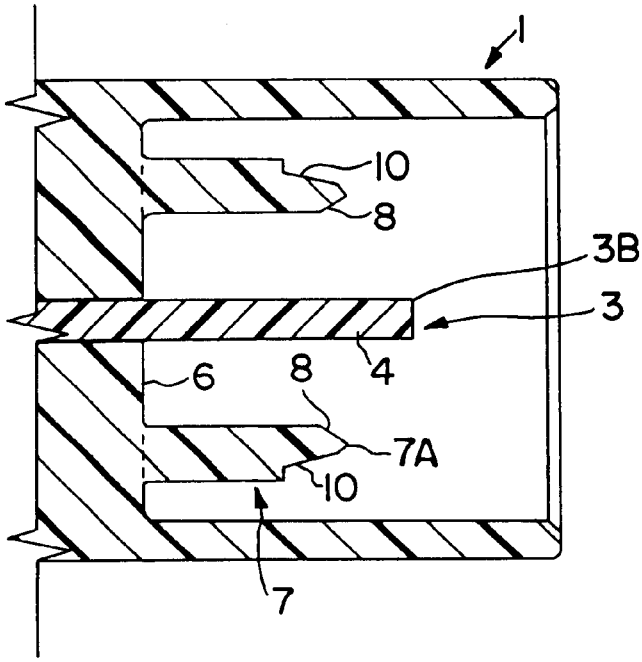
FIG. 3 of a section along A—A of FIG. 2.

A connector according to the invention is identified by the number 37 in FIG. 1, and is comprised of a substrate-side housing 1 and a wire-side housing 2 that are connectable with each other along a mating direction MD. Ends of the housings 1, 2 that are connected with each other are referred to as the front in the following description.

The substrate-side housing 1 is formed with a hollow receptacle 38 that opens at the front of the housing 1. Substrates 3 are accommodated in the substrate-side housing 1 and include projecting ends 3A that project substantially in the middle of the receptacle 38. The projecting ends 3A of the substrates 3 have leading corners 3B that are disposed rearwardly of the front end of the receptacle 38. Terminals 4 made e.g. of copper or other metal foils are applied on the projecting ends 3A.

The substrate-side housing 1 further includes a back wall 6 at the rear of the receptacle 38 and pressing portions 7 project forward from the back wall 6. More particularly, pairs of pressing portions 7 are spaced from and substantially parallel to the upper and lower sides of each substrate 3. The pressing portions 7 have leading ends 7A that are located more backward than the corners 3B of the substrates 3. Guide surfaces 8 are formed at inner leading ends of the pressing portions 7 and are angled toward the substrates 3. Contact avoiding recesses 10 are formed at outer leading ends of the pressing portions 7 opposite the guide surfaces 8.

The wire-side housing 2 includes terminal fittings 5 that can be brought into contact with the terminals 4 of the substrate-side housing 1. Each terminal fitting 5 is formed by bending an electrically conductive plate to define a wire-connecting portion 11 for connection with a wire W. A hollow connecting portion 16 is formed forward of the wire-connecting portion 11, and a contact piece 9 is formed inside the connecting portion 16. The contact piece 9 is resiliently or elastically deformable toward or away from the substrate 3, and can be brought resiliently or elastically into contact with the corresponding terminal 4.

Figure 4:
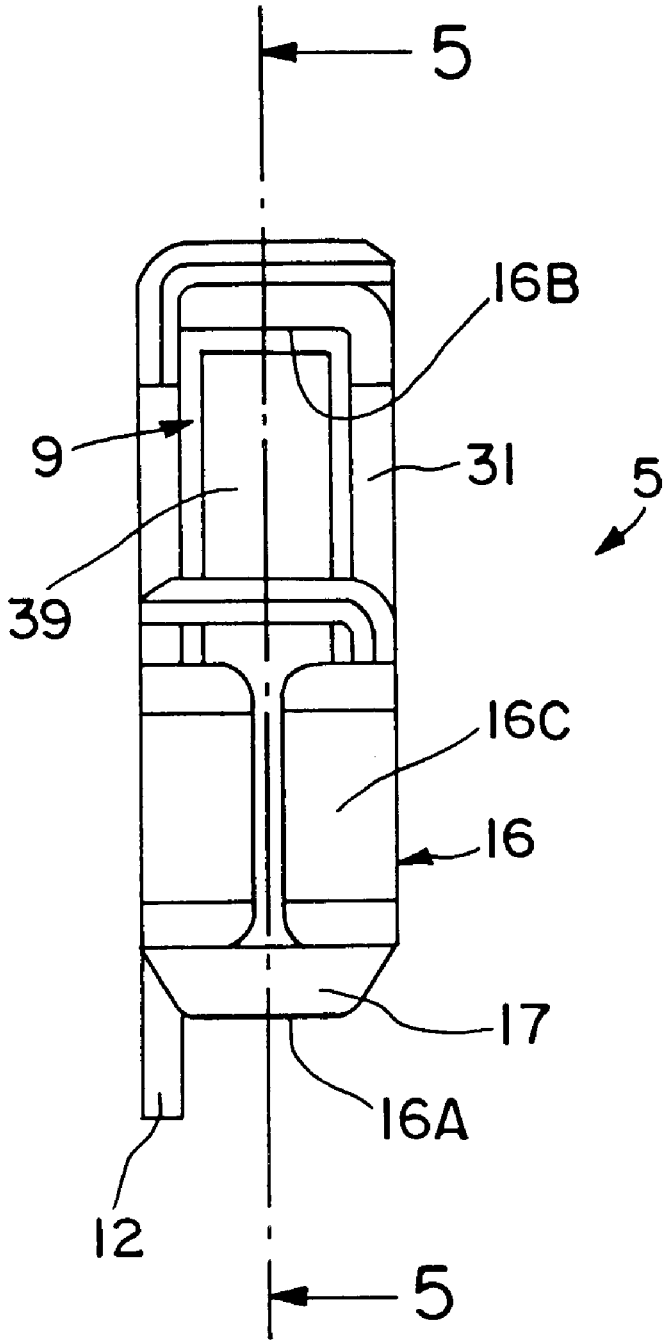
FIG. 4 is a front view of a terminal fitting.
Figure 5:
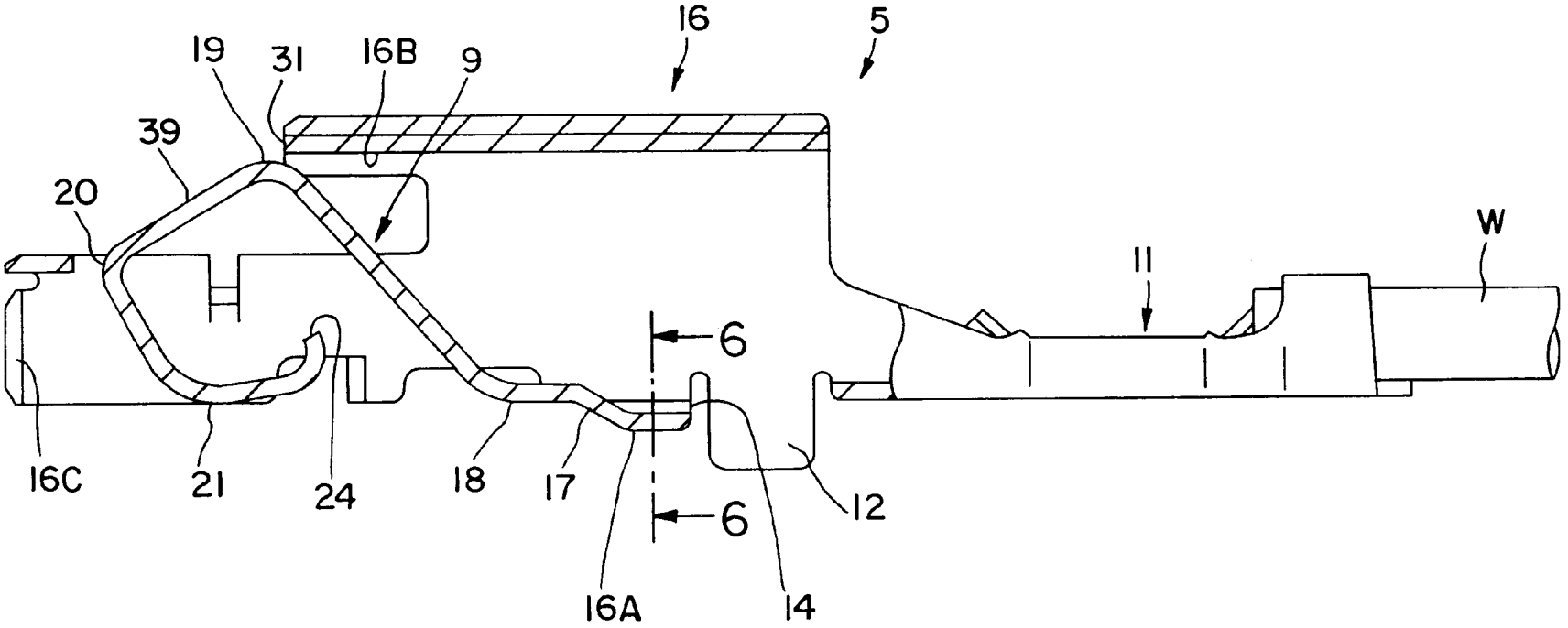
FIG. 5 is a section along B—B of FIG. 4.
Figure 6:
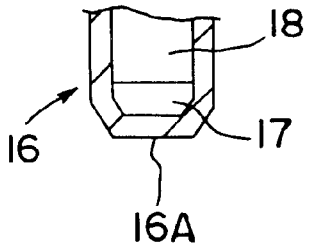
FIG. 6 is a section along C—C of FIG. 5.

The connecting portion 16 is substantially a rectangular parallelepiped. A stabilizer 12 projects down from the lower rear of the connecting portion 16, which is the side facing the substrate 3, as shown in FIGS. 4 and 5. The stabilizer 12 is provided only at the left side, as shown in FIG. 4, and fits in a groove 13A in a cavity 13 of the wire-side housing 2 to prevent the terminal fitting 5 from being mounted erroneously. An engaging portion 14 is near the stabilizer 12 at the bottom of the connecting portion 16 and is formed by folding and bending the plate material. The engaging portion 14 is engaged with an engaging piece 15 of the wire-side housing 2 to lock the terminal fitting 5 in the cavity 13. A slanted surface 17 is formed on a bottom wall 16A of the connecting portion 16 before the engaging portion 14 and slants upward away from the substrate 3, as shown in FIGS. 4 to 6. A base 18 is formed on a portion of the bottom wall 16A before the slanted surface 17, and the elastic piece 9 extends from the base 18 toward the inside of the connecting portion 16.

The contact piece 9 extends obliquely up to the front, is bent at a first bend 19 near an upper wall 16B of the connecting portion 16 and then extends obliquely down to the front, as shown in FIG. 5. The contact piece 9 is bent again at a second bend 20 near a front wall 16C of the connecting portion 16 and then extends obliquely down to the back. The first bend 19 is slightly below the upper wall 16B, so that the contact piece 9 is elastically or resiliently deformable up and away from the substrate 3. A slanted press-receiving portion 39 extends between the first and second bends 19 and 20 and can contact the guide surface 8 of the pressing portion 7.

A contact portion 21 is bent obliquely up from the second bent portion 20 and is located substantially at the same vertical position as the base 18 in its natural state where no pressing force acts on the contact piece 9. Thus, the contact portion 21 is spaced above the engaging portion 14 by the elevation of the slanted surface 17. Therefore, the contact portion 21 does not contact the engaging piece 15 while the terminal fitting 5 is being mounted into the cavity 13.

A portion of the contact piece 9 before the contact portion 21 is bent so that a free distal end 24 extends up in inner direction of the connecting piece 16 in FIG. 5. In this way, the contact portion 21 is near, but more forward than the free distal end 24.

The bottom wall 16A of the connecting portion 16 is open below the elastic contact piece 9. Thus, the contact portion 21 is exposed at the bottom of the terminal fitting 5. The leading end of the upper wall 16B of the connecting portion 16 also is cut away to form an opening 31, through which the corresponding pressing portion 7 of the substrate-side housing 1 is insertable.

The wire-side housing 2 is comprised of a housing main body 22 formed with cavities 13 for accommodating the terminal fittings 5, as shown in FIGS. 1 and 7–10. Retainer mount holes 25 are formed in the upper and lower walls of the housing main body 22 and communicate with the cavities 13.

The cavities 13 are disposed in upper and lower stages in the wire-side housing 2, and engaging pieces 15 project into the corresponding cavities 13 from partitioning walls 30 that separate the upper and lower cavities 13. Each engaging piece 15 is slightly elastically or resiliently deformable in a direction toward or away from the corresponding terminal fitting 5, and can be engaged with the engaging portion 14 when the terminal fitting 5 is mounted properly in the cavity 13. The engaging piece 15 is aligned substantially with the contact portion 21 of the terminal fitting 5 or is slightly closer to the substrate 3 than the contact portion 21.

Figure 7:
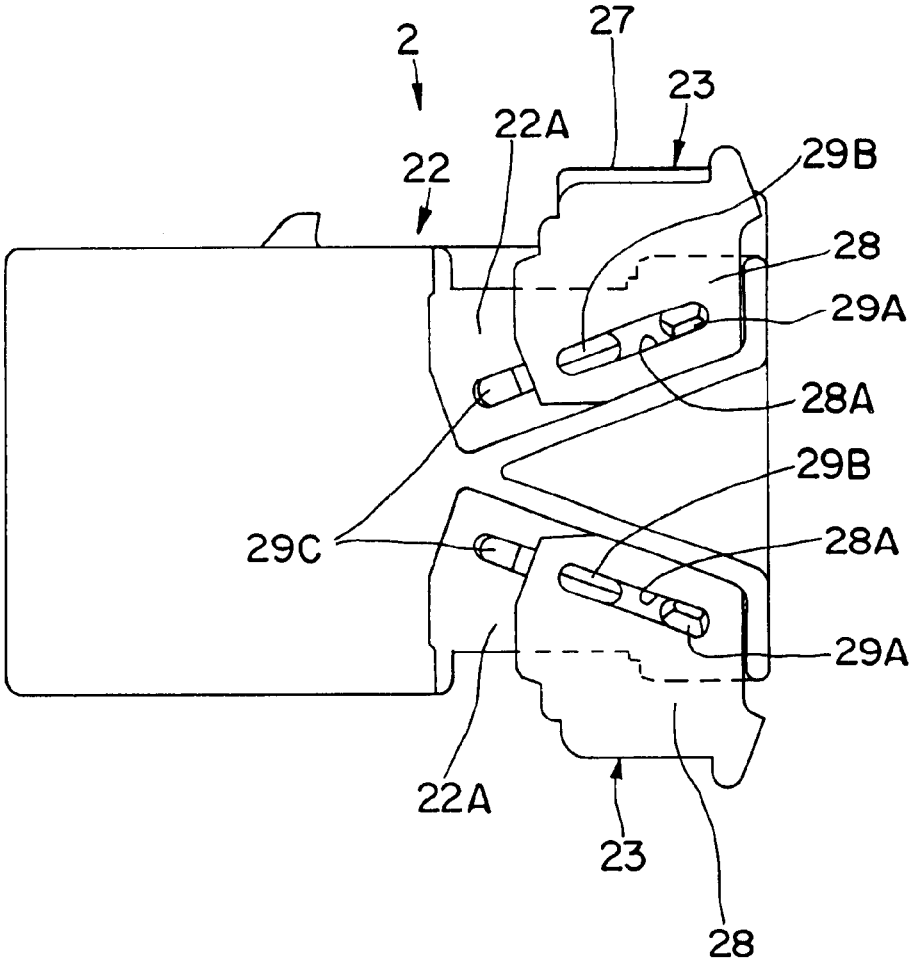
FIG. 7 is a side view of a wire-side housing.
Figure 8:
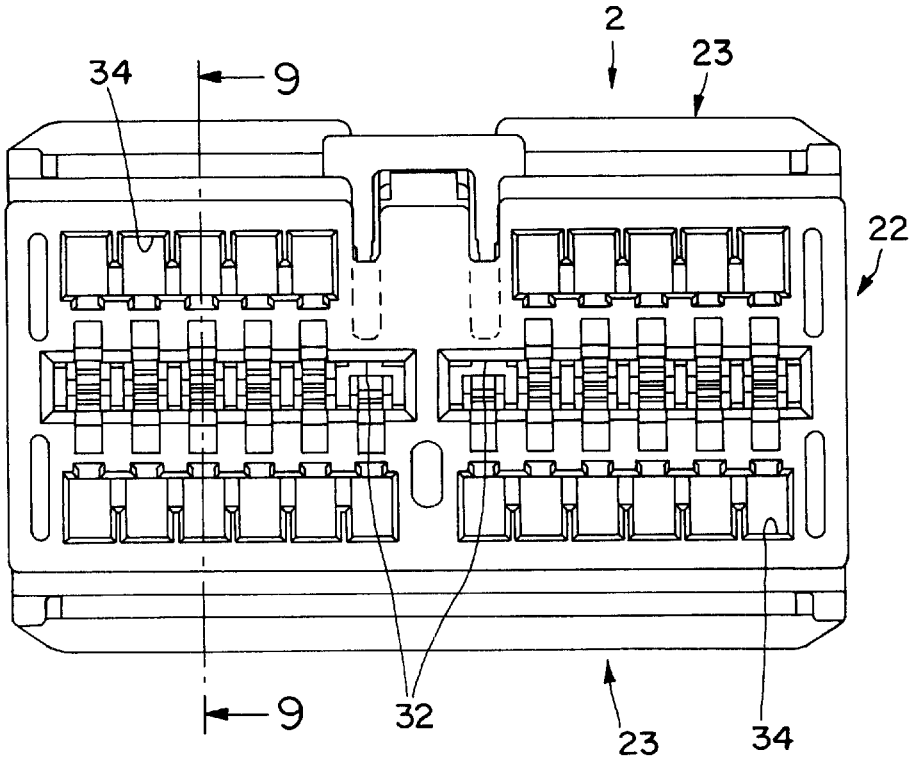
FIG. 8 is a front view of the wire-side housing.

Retainers 23 are mounted into the retainer mount holes 25. Each retainer 23 is substantially U-shaped and is comprised of a base 27 formed with projections 26 that are engageable with the terminal fittings 5. Arms 28 project toward the housing main body 22 from the left and right ends of the base 27. The arms 28 are located outside and substantially in contact with left and right side surfaces 22A of the housing main body 22. Each arm 28 is formed with an oblong locking groove 28A that extends obliquely. Thus, the retainer 23 can be engaged selectively with three locking projections 29A to 29C that project from the side surface 22A for locking the retainer in either of two states. Specifically, the locking projections 29A and 29B can be engaged with the locking groove 28A to achieve a partly locked state of the retainer 23, as shown in FIG. 7. In this condition, the projections 26 do not project into the cavities 13 and the terminal fittings 5 can be inserted into and withdrawn from the cavities 13. On the other hand, the locking projections 29B and 29C can be engaged with the locking groove 28A to achieve a fully locked state of the retainer 23. In this condition, the projections 26 are pressed into the cavities and are engaged with the terminal fittings 5 to supplement the locking effected by the engaging pieces 15.

Substrate insertion openings 32 are formed in the middle of the front surface of the housing main body 22 for permitting insertion of the substrates 3. The substrate insertion openings 32 communicate with the cavities 13 inside the housing main body 22. Further, pressing portion insertion openings 34 are formed before the cavities 13 in the housing main body 22 for inserting the pressing portions 7.

Figure 9:
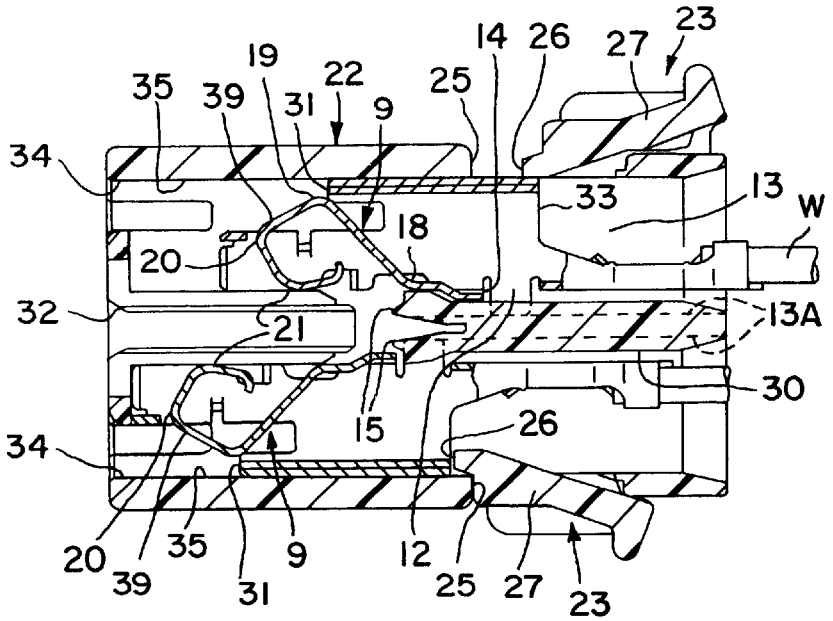
FIG. 9 is a section along D—D of FIG. 8 while terminal fittings are being mounted into the wire-side housing.

The retainers 23 initially are mounted on the housing main body 22 in the partly locked state shown in FIG. 9. The terminal fittings 5 connected with the wires W then are inserted into the cavities 13 so that the contact portions 21 face the substrate insertion opening 32.

The contact portion 21 is further away from the substrate 3 than the engaging portion 14. Thus, contact between the contact portion 21 and the engaging piece 15 can be avoided. As a result, the force required to insert the terminal fitting 5 is low, and the terminal fitting 5 will not be caught during insertion.

The slanted surface 17 of the terminal fitting 5 contacts the engaging piece 15 during the insertion of the terminal fitting 5 into the cavity 13. As a result, the engaging piece 15 undergoes a slight elastic or resilient inward deformation. The engaging piece 15 aligns with the engaging portion 14 when the terminal fitting 5 is pushed to its proper position. Thus, the engaging piece 15 is restored elastically substantially to its original shape to engage the engaging portion 14 of the terminal fitting 5. Thus, the terminal fitting 5 is locked in the cavity 13.

Figure 10:
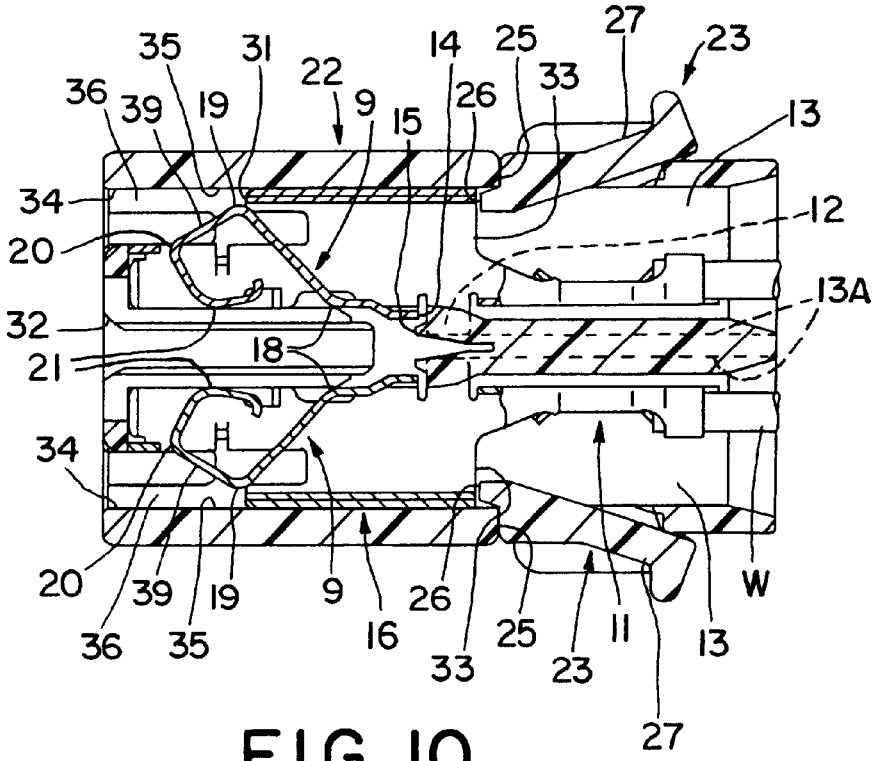
FIG. 10 is a side view in section after the terminal fittings are mounted into the wire-side housing.

The retainers 23 are pressed deeply into the retainer mount holes 25 along their oblique path and reach the fully locked state shown in FIG. 10 after the terminal fittings 5 are mounted into the specified cavities 13. Thus, the projections 26 engage receiving portions 33 at the rear ends of the connecting portions 16 of the terminal fittings 5 to achieve double locking of the terminal fittings 5 in the cavities 13.

A pressing portion insertion space 36 is formed in each cavity 13 adjacent the pressing portion insertion opening 34 and between the first bent portion 19 of the contact piece 9 and a wall surface 35 forming the cavity 13.

Figure 11:
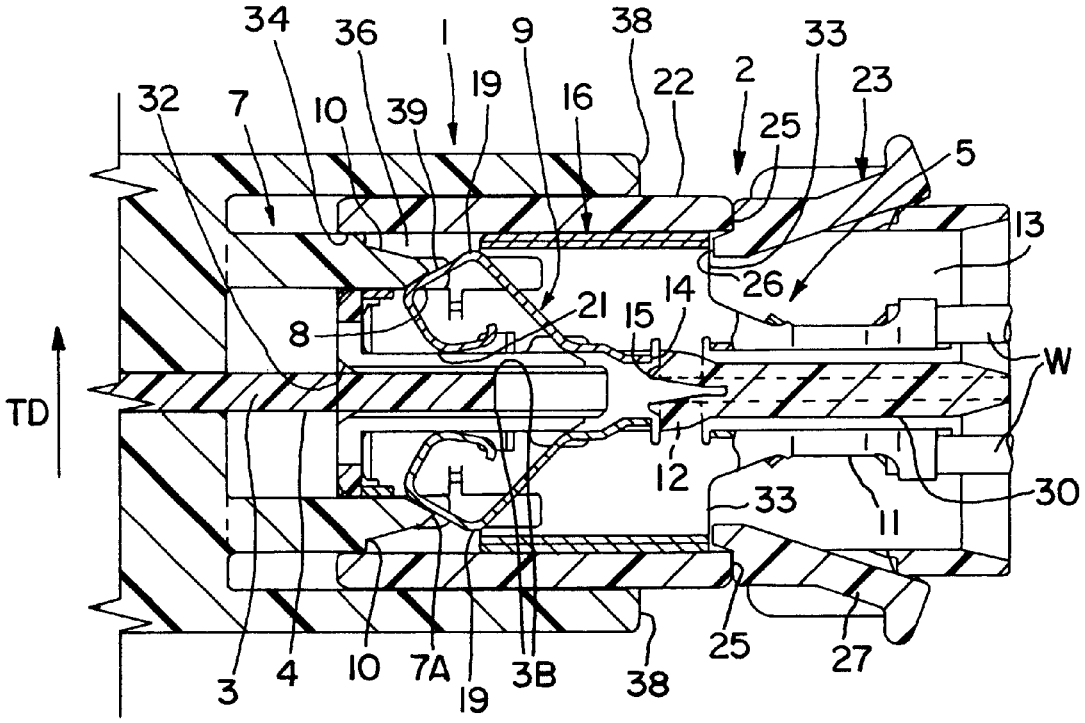
FIG. 11 is a side view in section (1) showing an intermediate stage of a connecting operation of the two housings.

The completely assembled wire-side housing 2 is connected with the substrate-side housing 1 as shown in FIGS. 1 and 11 to 13. First, as shown in FIG. 1, the housings 1, 2 are placed with their front surfaces substantially opposed to each other and a connecting operation is started by inserting the wire-side housing 2 into the substrate-side housing 1. As the connecting operation progresses, the substrates 3 enter the wire-side housing 2 through the substrate insertion openings 32 and then the pressing portions 7 enter the pressing portion insertion spaces 36 through the pressing portion insertion openings 34. As shown in FIG. 11, the contact portions 21 of the elastic contact pieces 9 pass the corners 3B of the substrates 3 and then the guide surfaces 8 of the pressing portions 7 start contacting the press-receiving portions 39. At this stage, however, the pressing portions 7 have not yet started deforming the contact pieces 9. Thus, the contact portions 21 and the substrates 3 remain separated.

Figure 12:
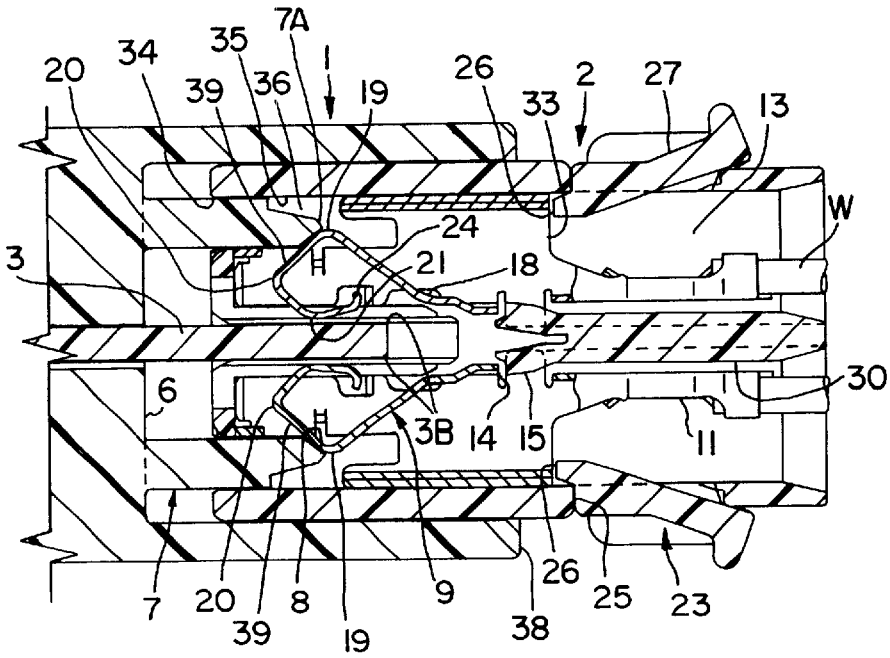
FIG. 12 is a side view in section (2) showing another intermediate stage of the connecting operation of the two housings.
Figure 13:
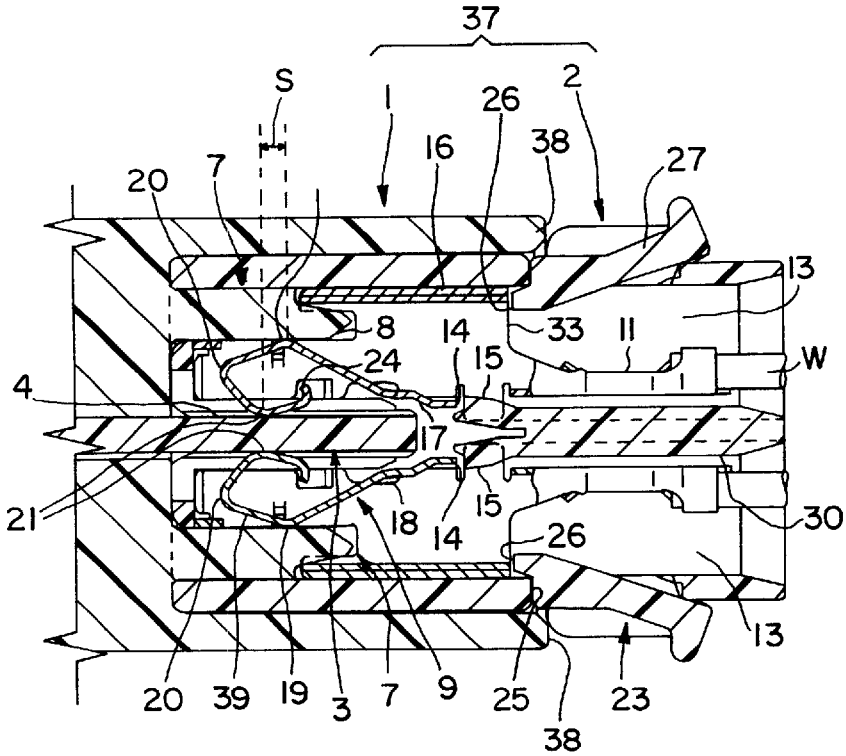
FIG. 13 is a side view in section when the connecting operation of the two housings is completed.
Figure 14:
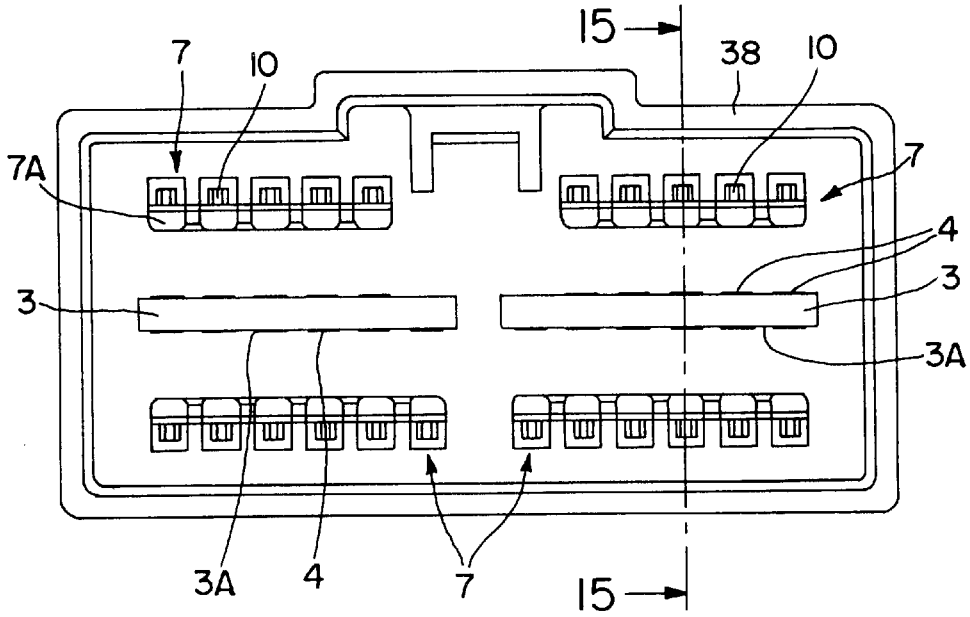
FIG. 14 is a front view of a substrate-side housing according to a second embodiment.

The substrates 3 are inserted more deeply through the substrate insertion openings 32 as the connection of the housings 1 and 2 proceeds. As a result, the guide surfaces 8 slide over and press the press-receiving portions 39, as shown in FIG. 12, and the elastic contact pieces 9 are deformed elastically or resiliently toward the substrates 3.

Assembly of the connector 37 is completed when the pressing portions 7 press the first bent portions 19 of the contact pieces 9 toward the substrates 3 and the contact portions 21 contact the terminals 4.

As described above, the elastic contact pieces 9 of the wire-side housing 2 are pressed toward the terminals 4 by the pressing portions 7 in the substrate-side housing 1 when the substrate-side housing 1 and the wire-side housing 2 are connected properly. Thus, the terminal fittings 5 and the terminal portions 4 are held stably held in contact.

The elastic contact pieces 9 are pressed toward the substrates 3 only after the contact portions 21 of the elastic contact pieces 9 pass the corners 3B of the substrates 3. Thus, the corners 3B of the substrates 3 cannot deform the elastic contact pieces 9.

The contact portion 21 is located more forward than the distal end 24 of the elastic contact piece 9. Thus, the distal end 24 of the elastic contact piece 9 cannot be caught by the substrate 3 even if the contact portion 21 is pulled back by the contact with the substrate 3 during the connecting operation of the housings 1, 2.

The elastic contact pieces 9 are at the retracted positions spaced from the corresponding outer surfaces of the substrates 3 along thickness direction TD before the housings 1, 2 are connected, and are moved by the pressing portions 7 into contact with the terminals 4 when the housings 1, 2 are connected. Thus the elastic contact pieces 9 cannot be deformed by the corners 3B of the substrates 3 during connection of the housings 1, 2.

The base 18 of the contact piece 9 is rearward from the contact portion 21. Thus, the pressing portion 7 can act close to the contact portion 21 with respect to forward and backward directions, as compared to a case where the base of a contact piece is at the front side and the contact portion is at the rear side. Accordingly, the length S in FIG. 13 can be shortened. The pressing forces from the pressing portions 7 are likely to act along the thickness direction TD of the substrates 3 and, accordingly, the contact portions 21 can be brought into contact with the substrates 3 in the vertical direction. Therefore, contact pressures between the substrates 3 and the elastic contact pieces 9 can be stabilized more easily.

The pressing portions 7 press the elastic contact pieces 9 toward the substrates 3 by direct contact. Hence, the pressing portion insertion spaces 36 are at the sides of the elastic contact pieces 9 opposite from the substrates 3. The pressing portion insertion spaces 36 can also accommodate elastic or resilient deformation of the contact pieces 9 in directions away from the substrates 3. Thus, the elastic contact pieces 9 can be deformed elastically toward the spaces 36 if the substrates 3 contact the elastic contact pieces 9 during the connecting operation of the housings 1, 2. Therefore, the elastic contact pieces 9 cannot be deformed improperly by the substrates 3.

A second embodiment of the invention is described with reference to FIGS. 14 to 21. No description is given to elements of the second embodiment identical to or having the similar or same functions as that of the first embodiment by identifying it by the same reference numerals.

A main difference between the first and second embodiments is the construction of a contact piece 51 of a terminal fitting 50. A base 52 of the contact piece 51 is at the front end of the terminal fitting 50. The contact piece 51 extends obliquely back from the base 52 in a direction away from the substrate 3 and is bent at a first bend 53 near the upper wall 16B to extend substantially along the upper wall 16B. The contact piece 51 is bent again at a second bend 54 to extend obliquely forward toward the substrate 3. Further, a leading end of the contact piece 51 is bent forward to form a contact portion 56. A distal end 55 at the leading end of the contact portion 56 faces forward of the terminal fitting 50 and toward a space inside the connecting portion 16. A slanted pressure-receiving portion 57 is defined between the base 52 and the first bend 53 for receiving a pressing force from the pressing portion 7.

Figure 15:
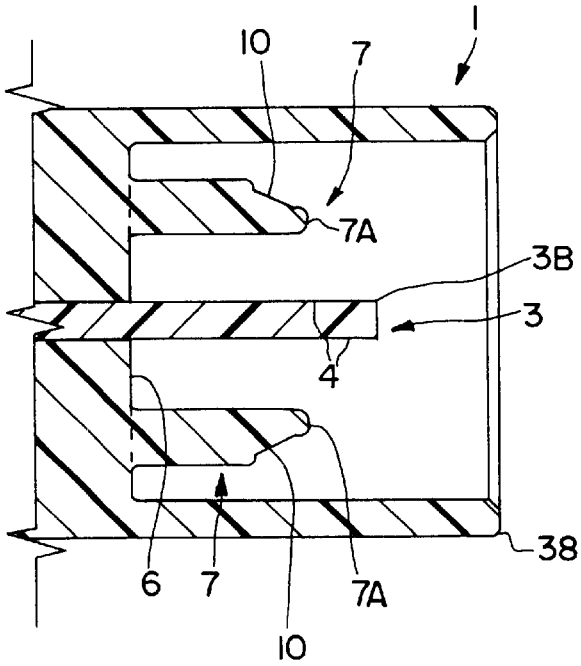
FIG. 15 is a section along E—E of FIG. 14.
Figure 16:
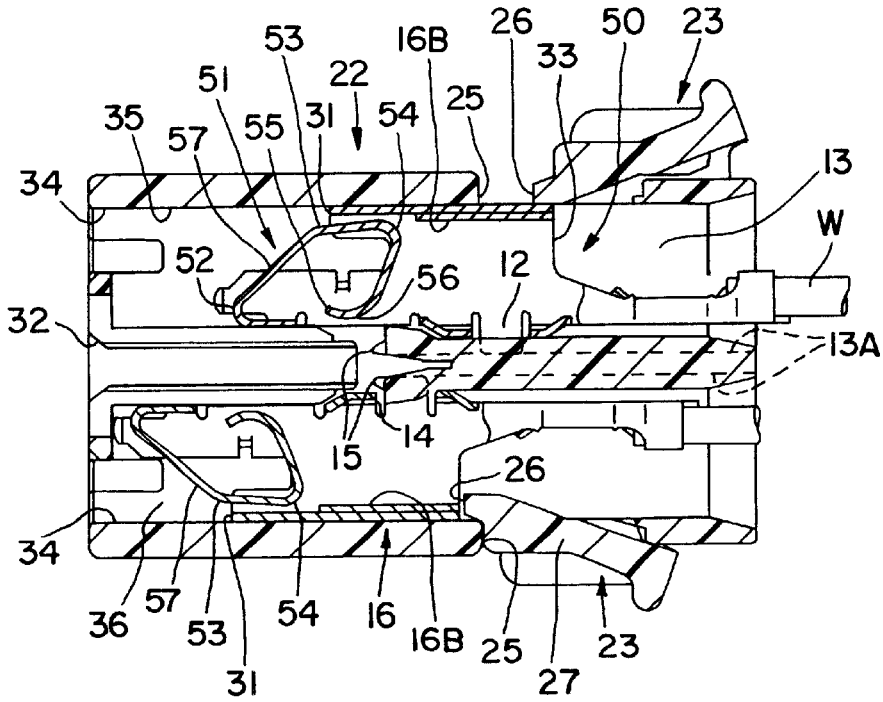
FIG. 16 is a side view in section while terminal fittings are being mounted into a wire-side housing.

A side of the pressing portion 7 that faces the substrate 3 is substantially planar and substantially parallel to the substrate 3, as shown in FIG. 15.

Figure 17:
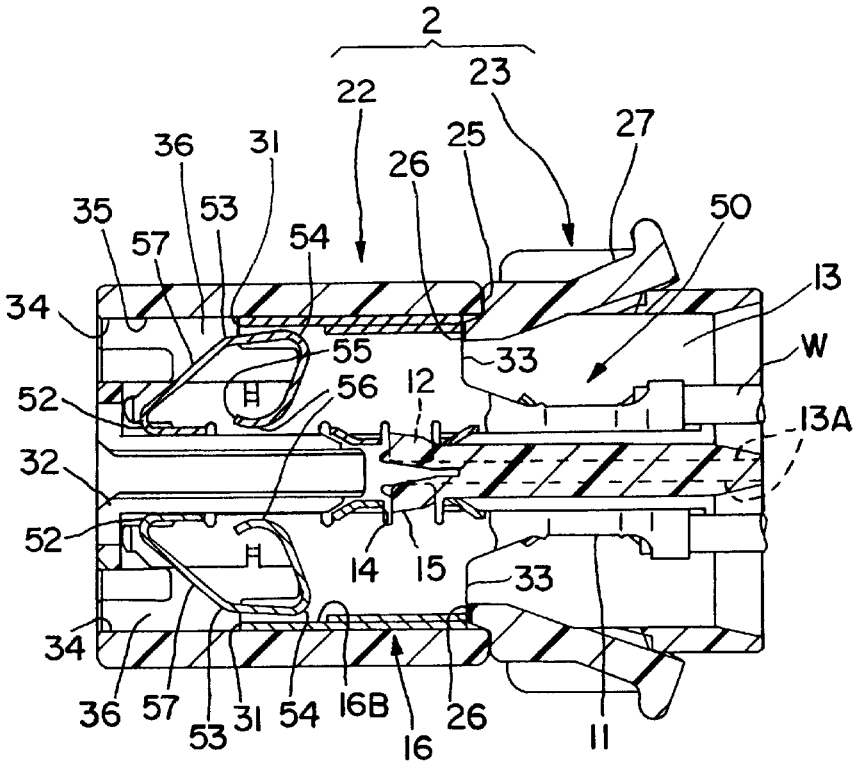
FIG. 17 is a side view in section after the terminal fittings are mounted into the wire-side housing.

In the second embodiment, the housing main body 22 and the retainers 23 are mounted in their partly locked state (upper retainer in FIG. 16) and the terminal fittings 50 are mounted into the cavities 13 of the wire-side housing 2. The retainers 23 then are brought into their fully locked state, as shown in FIG. 17. At this stage, the contact portions 56 are at retracted positions where the contact portions 56 and the terminals 4 cannot contact.

Figure 18:
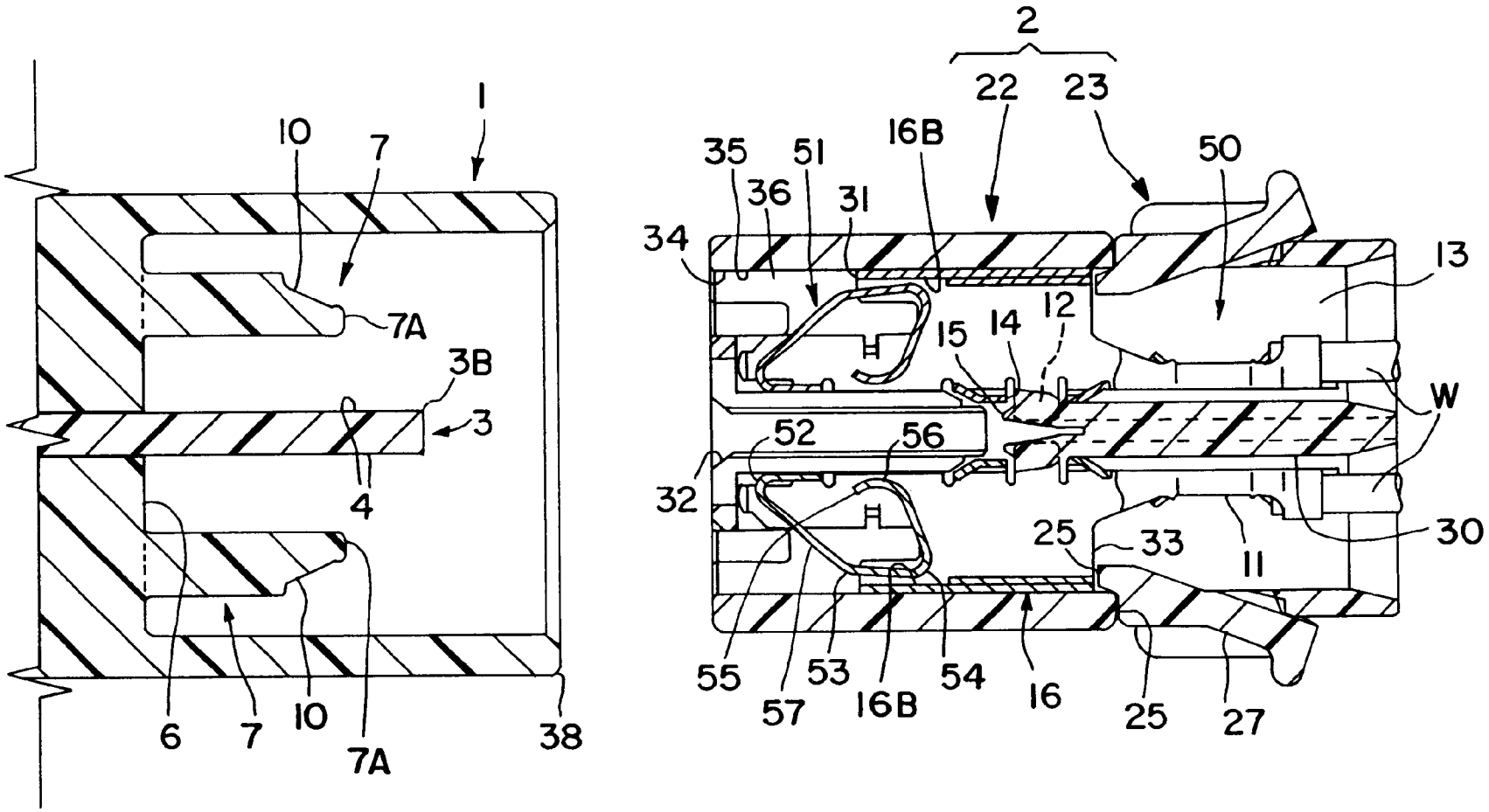
FIG. 18 is a side view in section before the two housings are connected.
Figure 19:
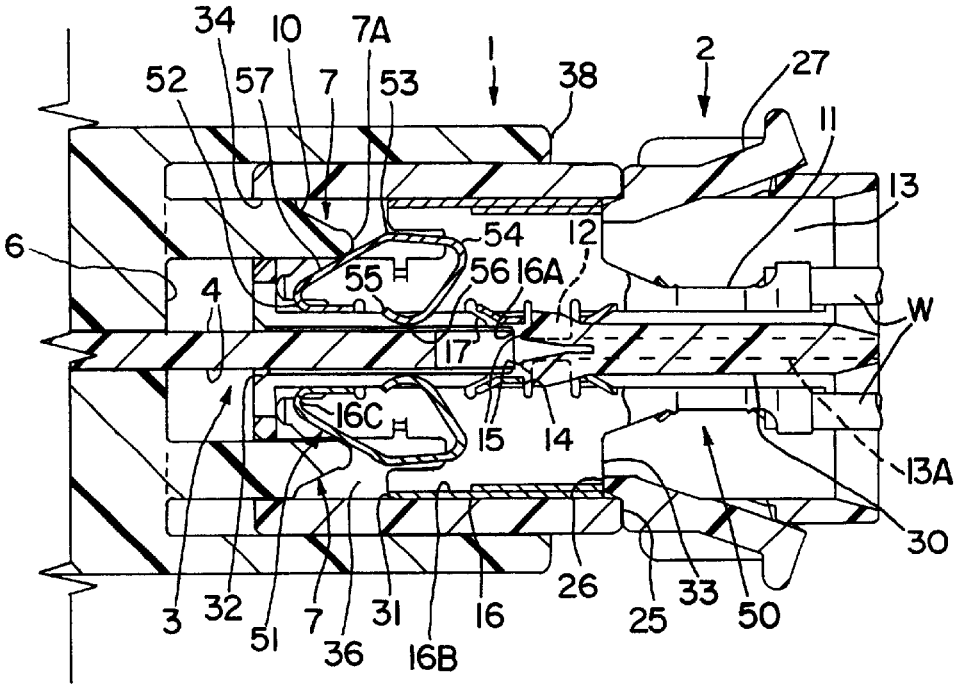
FIG. 19 is a side view in section (1) showing an intermediate stage of a connecting operation of the two housings.

As shown in FIG. 18, the housings 1, 2 are placed with their front surfaces substantially opposed to each other and are fitted to each other. The contact portions 56 of the contact pieces 51 pass the comers 3B of the substrates 3 during a connecting operation to reach a position where they can contact the terminal portions 4. At this stage, however, the contact pieces 51 and the terminals 4 are separated, as shown in FIG. 19.

Figure 20:
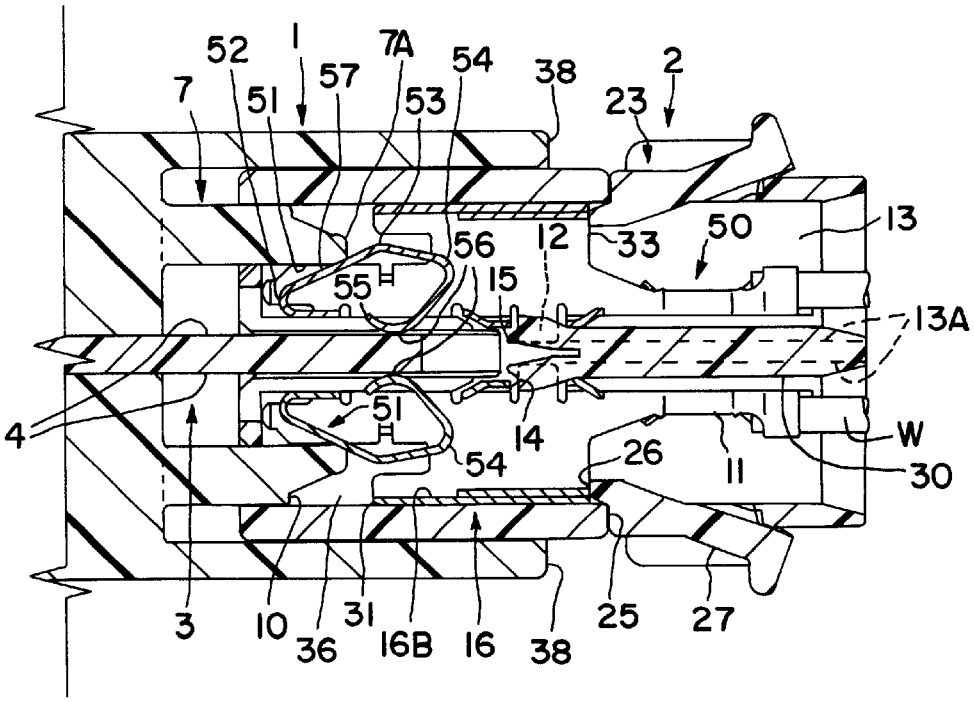
FIG. 20 is a side view in section (2) showing another intermediate stage of the connecting operation of the two housings.
Figure 21:
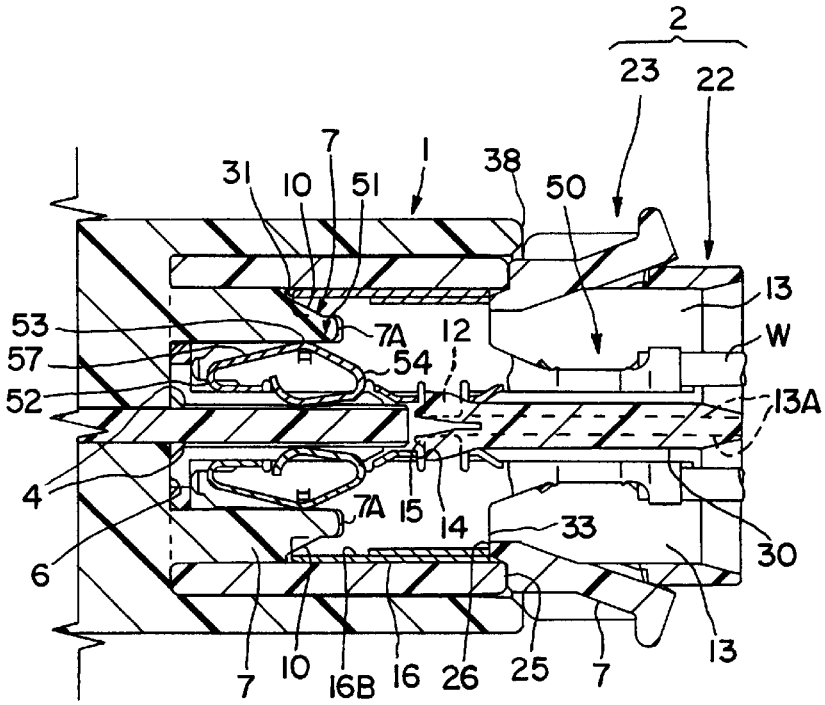
FIG. 21 is a side view in section when the connecting operation of the two housings is completed.
Figure 22:
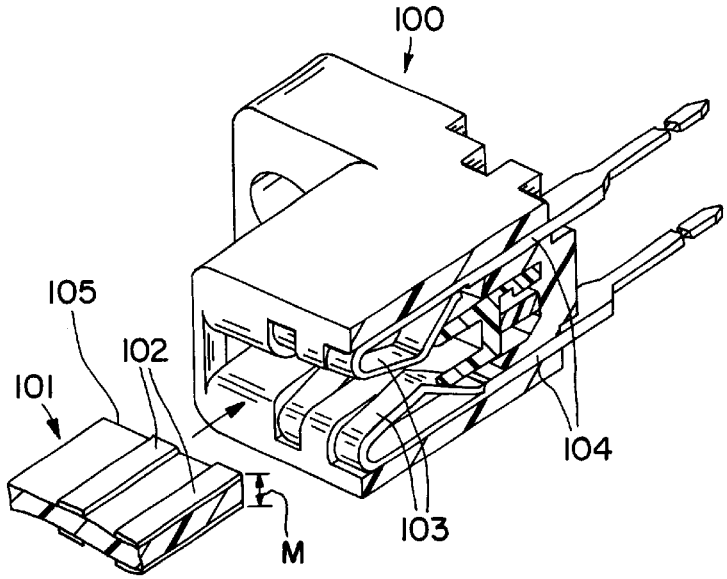
FIG. 22 PRIOR ART
FIG. 22 is a perspective view partly in section showing a prior art card edge connector.
Figure 23:
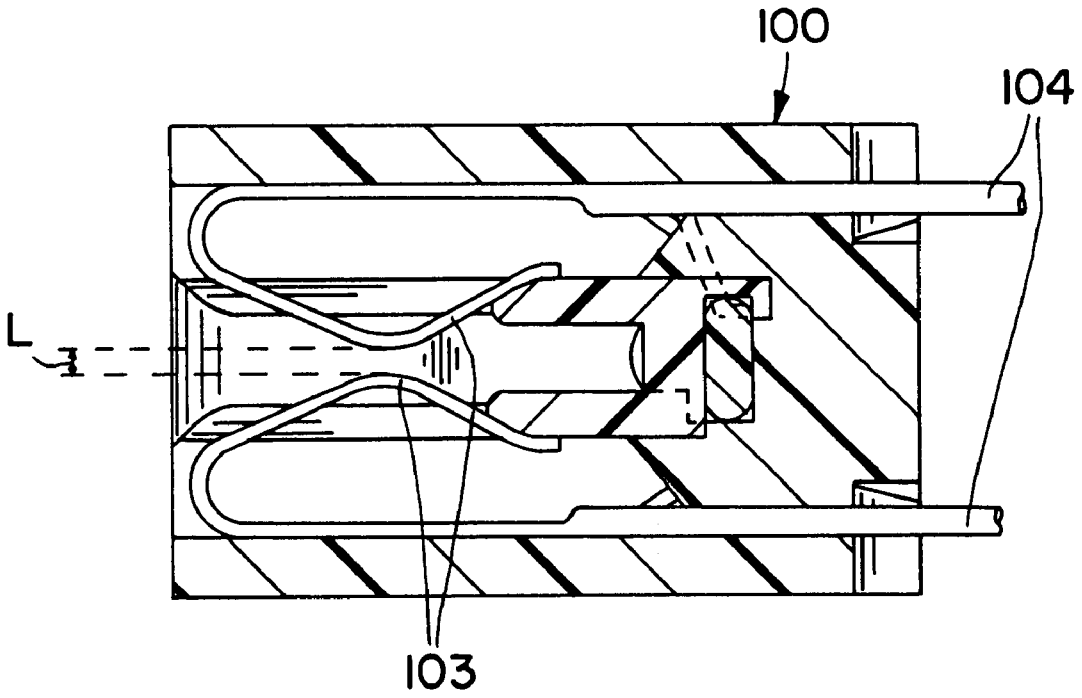
FIG. 23 PRIOR ART
FIG. 23 is a side view in section showing the prior art card edge connector.

As the connecting operation of the housings 1, 2 progresses, the substrates 3 enter the back side of the wire-side housing 2 and the leading ends 7A of the pressing portions 7 press and deform the contact pieces 51 resiliently toward the substrates 3, as shown in FIG. 20. Finally, when the connecting operation is completed, the pressing portions 7 press the contact pieces 51 toward the substrates 3 to bring the contact portions 56 into contact with the terminals 4.

As described above, the same functions and effects as the first embodiment can be obtained in this embodiment as well.

The technical scope of the present invention is not limited to the foregoing embodiments, embraces, for example, a following embodiment, and also extends to the scope of equivalents.

Although the wire-side housing is adapted to accommodate the terminal fittings connected with the ends of the wires in the foregoing embodiments, the second housing is not necessarily provided at the ends of the wires, but may be provided, for example, on the substrates or the like according to the present invention.

What is claimed is:

1. A connector, comprising:

a wire-side housing having opposite front and rear ends, a pair of parallel outer surfaces extending rearwardly from said front end and at least one pair of opposed cavities extending between said front and rear ends and aligned substantially parallel to said outer surfaces of said wire side housing, at least one pair of opposed terminal fittings mounted in the respective cavities rearwardly of the front end of the wire-side housing, the terminal fittings in said pair being spaced from one another by a selected distance; and a substrate-side housing having an open front end and a receptacle extending into the open front end, the receptacle having parallel inner surfaces spaced from one another by a distance for slideably receiving the parallel outer surfaces of the wire-side housing, a substrate with an outer end projecting into said receptacle and spaced rearwardly from the open front end, at least one pair of terminals provided on opposite sides of the outer end of the substrate, the substrate and the terminals defining a thickness less than the selected distance between the terminal fittings in said pair of terminal fittings, pressing portions projecting in the receptacle on opposite sides of the substrate, the pressing portions being spaced from the open front end by a distance greater than the spacing of the outer end of the substrate from the open front end, the pressing portions being disposed to deflect the terminal fittings into contact with the terminals of the substrate after the parallel inner surfaces of the receptacle slideably engage the parallel outer surfaces of the wire-side housing and after the substrate is between the terminal fittings in the respective pair.

2. The connector of claim 1, wherein the housings are mateable along a mating direction, the pressing portions having a front end aligned to the mating direction at an acute angle.

3. The connector of claim 2, wherein the pressing portions come into contact with corresponding press receiving portions of the terminal fittings, the press receiving portions being arranged at an acute angle to a mating direction of the connector housings.

* * * * *